United States Patent [19]

Louvel

[11] 3,952,270

[45] Apr. 20, 1976

[54] HYPERFREQUENCY BAND-CUT FILTER

[75] Inventor: Guy Louvel, Antony, France

[73] Assignee: Compagnie Industrielle des Telecommunications Cit-Alcatel, Paris, France

[22] Filed: Jan. 24, 1975

[21] Appl. No.: 543,741

[30] Foreign Application Priority Data

Jan. 25, 1974 France ..... 74.02517

[52] U.S. Cl. ..... 333/73 W; 333/81 B; 333/83 R

[51] Int. Cl.[2] ..... H01P 1/20; H01P 1/22; H01P 5/12; H01P 7/06

[58] Field of Search ..... 333/73 W, 81 B, 83 R, 333/98 R, 22 R

[56] References Cited

UNITED STATES PATENTS

| | | | |
|---|---|---|---|
| 2,785,381 | 3/1957 | Brown | 333/73 W |
| 3,187,277 | 6/1965 | Wantuch | 333/73 W |
| 3,353,123 | 11/1967 | Met | 333/73 W |
| 3,451,014 | 6/1969 | Brosnahan et al. | 333/73 W |
| 3,464,035 | 8/1969 | Van Kol | 333/73 W |
| 3,593,220 | 7/1971 | Rooney | 333/73 W |

*Primary Examiner*—Alfred E. Smith
*Assistant Examiner*—Marvin Nussbaum
*Attorney, Agent, or Firm*—Sughrue, Rothwell, Mion, Zinn & Macpeak

[57] ABSTRACT

Hyperfrequency band-cut filter enabling the transmitting of a first lower frequency band and cancelling a second frequency band which is absorbed. It is constituted by a compact assembly comprising two blocks fixed to each other and forming a rectangular wave guide whose upper and lower walls are drilled with slots connected to resonant cavities at the second frequency band, hollowed out in the faces opposite to the faces of the rectangular wave guide and comprising, moreover, two plates which are screwed onto said blocks overlying said cavities.

3 Claims, 2 Drawing Figures

HYPERFREQUENCY BAND-CUT FITER

BACKGROUND OF THE INVENTION

1. FIELD OF THE INVENTION

The present invention concerns a hyperfrequency band-cut filter and more particularly a filter formed according to the technique of wave guides transmitting a frequency band and absorbing another frequency band whose average frequency is greater than that of the first.

2. DESCRIPTION OF THE PRIOR ART

The problem of absorbing a first frequency band greater than a second frequency band is relatively difficult in the technique of wave guides, for these latter act as high-pass filters. It is therefore compulsory to accept, in a wave guide having a cut-off frequency, both the higher band of frequencies to be absorbed and the lower band of frequencies to be transmitted. It is however necessary in the elements which follow a duplexer to prevent the emitting frequencies from reaching the parametric receiving amplifiers and to absorb them so that the emitting energy does not return to the duplexer. For that purpose, it is a known method to arrange, above a first rectangular guide accepting the two receiving and emitting bands, several rectangular guides, perpendicular to the first, whose length is $0.5\lambda_g$ ($\lambda_g$ being the wavelength in the guide for the average of the emitting band) and having a transversal dimension such that it be at the cut for the receiving band frequency. These perpendicular guides form transmission elements ended by resistive charges which have the function of absorbing the emitting band. It is known that the first guide is an over-dimensioned guide at the frequencies of the emitting band and that it allows, at these frequencies, the higher rectangular $TE_{20}$ mode to pass, whereas the guide is normally fed in the rectangular $TE_{10}$ mode at receiving frequencies. Consequently, to cancel the energy at the emitting frequency, it is necessary to couple the guides at the places where the electric and magnetic fields of the rectangular $TE_{20}$ mode are maximum, in other words, on either side of the middle of the first rectangular guide. That property has already been used and known filters comprise two rows of guides perpendicular to the first guide and spaced apart from each other. The disadvantage of that solution is the producing of bulky filters, which are not solid from the mechanical point of view, relatively difficult to machine and expensive.

The filter according to the present invention overcomes these disadvantages. Indeed, the latter is formed by a compact assembly which is easy to machine and has a high efficiency characteristic.

SUMMARY OF THE INVENTION

The present invention has as its object a hyperfrequency bandcut filter absorbing a first frequency band higher than a second frequency band which is transmitted, that filter comprising a main rectangular wave guide whose input receives the first and second frequency bands and whose output sends out the second non-attenuated frequency band and the first highly attenuated band and comprises, for absorbing said first band, resistive charges in secondary rectangular guides having transversal dimensions smaller than those of the main rectangular wave guide, said secondary guides being parallel to the main guide and arranged on either side of that guide along the walls corresponding to the large sides of the cross-section of that guide with which the said secondary guides communicate through several slots. The invention is characterized in that said secondary guides comprise metallic transversal walls limiting resonant cavities having a length of $0.5\lambda_g$, $\lambda_g$ being the average frequency of the said first band and that said slots have variable dimensions in the end cavities.

According to another particularity of the invention, the filter is constituted by two blocks joined together by fixing means and each comprising, on a first face supporting the slots, half of the longitudinal cross-section of the rectangular wave guide and on a second face two longitudinal alveoli separated by transversal partitions, each of the two blocks being covered on the said second face by a plate screwed onto the block and comprising, facing the block, several resistive charges.

According to another particularity of the invention, the transversal lengths of the said variable slots are comprised between 0 and $0.5\lambda_g$, $\lambda_o$ being the greatest wavelength of the first frequency band.

With reference to the diagrammatic FIGS. 1 and 2 herewith, an example of embodiment of the present invention, given purely by way of illustration and having no limiting character will be described hereinafter. The same elements shown in these two figures bear the same reference numerals.

DESCRIPTION OF THE PREFERRED EMBODIMENT

Figure 1:
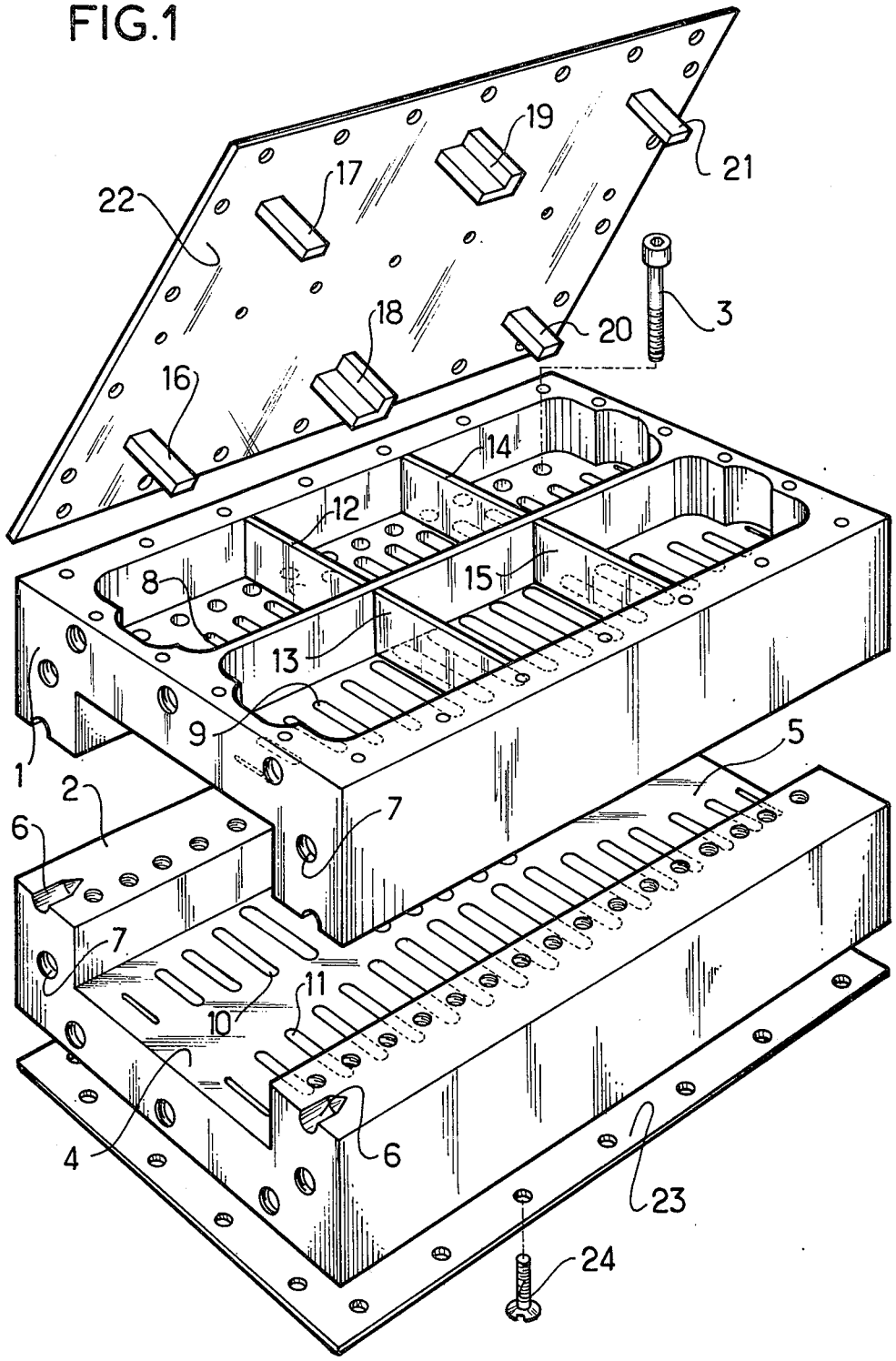
FIG. 1 is a diagrammatic exploded perspective view of the filter according to the invention.

Such as shown in the figures, the filter consists of two blocks 1 and 2, (an upper block and a lower block), which are identical, joined together by screws 3 or the like, so as to form a rectangular wave guide whose input is referenced at 4 and whose output is referenced at 5. The wave guide has a large side of about 50 millimeters which determines the frequencies transmitted in rectangular $TE_{10}$ mode, more particularly those which are greater than 3.5 GHz. This is a standard wave guide which may be added to other guides due to recesses 6 for braces and tapped holes such as 7 used for fixing the flanges of another guide. In this example, the guide must receive a frequency band intended for receiving at 2.7 to 4.2 GHz and a frequency band coming from the emitter from 5.9 to 6.4 GHz. At these emitting frequencies, the guide is over-dimensioned and it then admits the higher rectangular $TE_{20}$ mode having as its characteristic that of having two maximums of electric field on either side of the middle of the large side of the rectangular wave guide. With a view to absorbing these emitting frequencies, slots 8, 9, 10, 11 are arranged in two rows, the first two drilled in the wall of the block 1, the second two drilled in the wall of the block 2. Coupling is effected particularly well because the maximum electric and magnetic currents of the rectangular $TE_{20}$ mode are arranged perpendicular to the slots. There are two longitudinal alveoli surrounding each of the rows of slots 8 and 9 on the upper face of the block 1. There is an identical configuration, which is not visible in FIG. 1, on the lower face of the block 2. Each of the alveoli is barred transversally by partitions such as 12, 13, 14, 15 forming between the partitions 12 and 14, for example, a resonant cavity having a length of $0.5\lambda_g$, $\lambda_o$ being the wavelength in the guide for the average frequency of the emitting frequency band. Thus, a resonant cavity or, in terms of circuits, a tuned circuit coupled to the transmission line formed by the rectangular wave guide, is thus obtained. In order to enlarge the absorption frequency band, the coefficient of overvoltage of the resonant cavities is lowered by arranging resistive loads 17 to 21 in the cavities. These charges, which may be ferrites, are cemented by means of a polymerizable resin to the surface of plates such as 22 and 23 fixed to the blocks 1 and 2 by screws such as 24.

Figure 2:
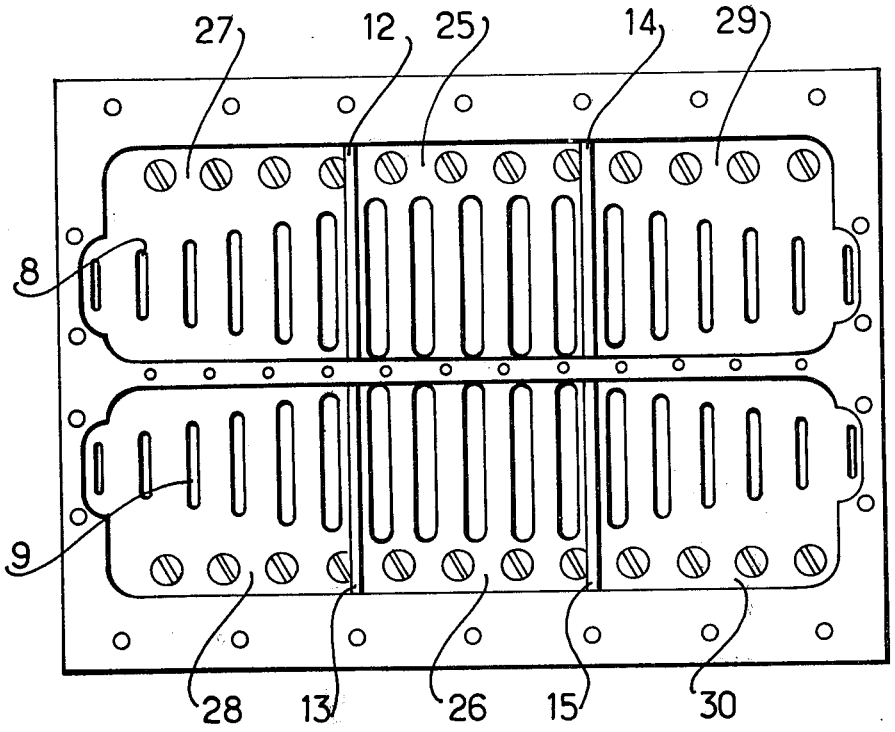
FIG. 2 is a diagrammatic plan view of the filter of FIG. 1, with the lid removed.

According to FIG. 2, it will be seen that the slots 8 and 9 are not all identical except between the partitions 12–14 and 13–15 where they correspond to total coupling cavities 25 and 26. For impedance adaptation reasons the coupling is tighter and tighter going from the transition cavities 27–28 from the input 4 of the wave guide up to the partitions 12–13 then slacker and slacker in the transition cavities 29–30 from the partitions 14–15 up to the output 5 of the wave guide.

In these transition cavities, the slots are larger and larger and longer and longer. Their length is comprised between 0 and $0.5\lambda_o$, $\lambda_o$ being the wavelength corresponding to the lowest frequency of the emitting frequency band. The length of the slots in the total coupling cavities 25–26 is $0.45\ \lambda_o$.

The attenuation obtained in the emitting frequency band is from 16 dB to 20 dB with two total coupling cavities 25–26 and their symmetrical counterparts and four transition cavities 27-28-29-30 and their symmetrical counterparts. To obtain a greater attenuation, it is sufficient to lengthen the filter and to increase the number of the total coupling cavities, maintaining the same number of transition cavities. Thus, it is possible to obtain rejections in the order of 30 dB. The losses by insertion in the receiving frequency band are in the order of 0.05 dB.

The band cut filter in the invention may be used in all cases where it is necessary to attenuate a frequency band higher than the transmitted frequency band.

Particularly interesting applications relate to hyperfrequency filtering with wave guides.

I claim:

1. In a hyperfrequency band-cut filter for absorbing a first frequency band higher than a second frequency band which is transmitted, said filter comprising; an elongated main rectangular wave guide whose input receives the first and second frequency bands and whose output sends out second non-attenuated frequency band and the first highly attenuated band, second rectangular guides for absorbing said first band, resistive loads in said secondary rectangular guides, said rectangular guides having transversal dimensions smaller than those of the main rectangular wave guide and extending parallel to the main guide and arranged on either side of that guide along opposed longitudinal walls of said main guide and having a plurality of transversal slots within said longitudinal walls for communicating said secondary guides with said main guide, the improvement wherein: metallic transversal walls within each secondary guide form longitudinally separate resonant cavities of a length equal to $0.5\lambda_g$, where $\lambda_g$ is the average wavelength of said first band, a plurality of said transversal slots open into each of said longitudinally spearate resonant cavities, and wherein said slots within said longitudinal walls opening to the end resonant cavities adjacent the input and output of said main rectangular wave guides are of decreasing size in the direction from the center of the filter outwardly towards said main wave guide input and output.

2. The filter according to claim 1, wherein: two blocks are joined together by fixing means and each block comprises, on the face of said longitudinal wall carrying said slots, a longitudinal recess defining half of the longitudinal cavity cross-section of said rectangular wave guide and, on a second face of said longitudinal wall, parallel longitudinal alveoli defining said secondary guides with each alveoli being longitudinally separated by said transversal partitions, and each of said blocks are covered on said second face by a plate screwed onto said block and supporting said resistive loads facing said longitudinal walls and being positioned within respective resonant cavities.

3. The filter according to claim 1, wherein: the transversal length of said slots within said end cavity vary within the range of 0 to $0.5\lambda_o$, wherein $\lambda_o$ is the largest wavelength of said first frequency band.

* * * * *